United States Patent [19]

Toton et al.

[11] 4,372,214

[45] Feb. 8, 1983

[54] EXPLOSIVE AUTO-ENHANCEMENT DEVICE

[75] Inventors: Edward T. Toton, Columbia; Elihu Zimet, Silver Spring, both of Md.

[73] Assignee: The United States of America as represented by the Secretary of the Navy, Washington, D.C.

[21] Appl. No.: 185,076

[22] Filed: Sep. 8, 1980

[51] Int. Cl.[3] ..... F42B 1/00

[52] U.S. Cl. ..... 102/305; 102/701

[58] Field of Search ..... 29/421 M; 89/8; 102/200, 209, 293, 305, 475, 701; 310/10

[56] References Cited

U.S. PATENT DOCUMENTS

| | | | |
|---|---|---|---|
| 3,356,869 | 12/1967 | Hilton et al. | 310/10 |
| 3,478,231 | 11/1969 | Knoepfel et al. | 89/8 |
| 3,501,828 | 3/1970 | Schultz | 29/421 M |
| 3,522,459 | 8/1970 | Stubbs et al. | 310/10 |
| 3,985,076 | 10/1976 | Hart et al. | 89/8 |
| 4,325,305 | 4/1982 | Pastine | 102/305 |

OTHER PUBLICATIONS

The Illustrated Science and Invention Encyclopedia, "Detonator", 1977, vol. 6, p. 736.

*Primary Examiner*—Stephen C. Bentley

*Attorney, Agent, or Firm*—R. S. Sciascia; A. L. Branning; W. R. Henderson

[57] ABSTRACT

An explosive auto-enhancement device for providing higher detonation pressure than can be achieved with conventional explosives by the use of magnetic precompression for enhancing the detonation wave. A cylindrical armature containing an explosive charge is coaxially spaced within a helical field generator winding with a first end of the armature being electrically coupled to the helical winding. A "seed" magnetic field is provided to the helical winding prior to the initiation of the explosive charge. When the explosive charge is initiated, forming a detonation wave, the other end of the cyclindrical armature expands and is coupled to the helical winding, thus completing the electrical circuit between the winding and the armature. As the detonation wave continues through the explosive charge, more of the coils of the helical winding are short circuited which reduces the inductance and results in increased magnetic flux within the winding. A magnetic pressure appears ahead of the detonation wave due to the increased magnetic flux and compresses the undisturbed armature and contained explosive, causing the detonation wave to increase in velocity and pressure. The detonation wave is thus continually accelerated by the generation of magnetic pressure preceeding the detonated explosive wave.

12 Claims, 2 Drawing Figures

EXPLOSIVE AUTO-ENHANCEMENT DEVICE

BACKGROUND OF THE INVENTION

The present invention relates to a device for the auto-enhancement of an explosive charge and more particularly to a device for the auto-enhancement of an explosive charge by the use of magnetic precompression.

Prior art devices for generating electrical current by explosive means are taught in U.S. Pat. Nos. 3,522,459 to Stubbs et al., and 3,985,078 to Hart et al. In both Stubbs et al and Hart et al electrical current pulses are generated by exploding an explosive charge to compress lines of magnetic force thus producing current in an output circuit element coaxial with the explosive charge. Neither Stubbs et al nor Hart et al teach the use of the explosively generated current for the auto-enhancement of the explosive detonation wave using magnetic precompression.

Presently, the only known method of achieving increased detonation pressure in condensed explosives is the chemical formulation of new explosives having larger energy release per gram and larger initial density than known explosives. Chemical enhancement of the explosive offers the possibility of percentage increases over existing condensed explosives, but can not offer the possibility of large increases because of the inherent limitations in the binding energies of atoms. The explosive auto-enhancement device of the subject invention provides a means of augmenting the explosive detonation of an explosive charge.

SUMMARY OF THE INVENTION

Accordingly, there is provided in the present invention an explosive auto-enhancement device for providing higher detonation pressures than can be achieved with conventional explosives by the use of magnetic precompression for enhancing the detonation wave. The magnetic precompression causes the detonation wave to increase in velocity and pressure.

The device is constructed with a cylindrical armature containing an explosive charge. The armature is coaxially spaced within a helical field generator winding with a first end of the armature being electrically coupled to the helical winding. The explosive charge is provided with a detonator adjacent the other end of the cylindrical armature. A "seed" magnetic field is provided to the helical winding prior to initiation of the explosive charge. Upon initiation of the explosive charge by the detonator, a detonation wave is initiated in the explosive charge and expands and crowbars the armature to the helical winding. The armature is coupled to the helical winding, thus completing the electrical circuit between the winding and the armature.

As the detonation wave proceeds through the explosive charge, more of the coils of the helical winding are short circuited which rapidly reduces the winding inductance and results in increased magnetic flux within the winding. The increased magnetic flux creates a magnetic pressure ahead of the detonation wave due to the increased coil inductance, and compresses the undisturbed armature and explosive charge, causing the detonation wave to increase in velocity and pressure. The pressure and velocity of the detonation wave accelerates the process of armature expansion, flux generation, and thus increases the degree of precompression ahead of the detonation wave. The detonation wave is thus continually accelerated by the generation of magnetic pressure preceeding the detonation wave and results in a highly overdriven detonation wave at the end of the armature.

OBJECTS OF THE INVENTION

It is an object of the present invention to provide a device for auto-enhancement of explosive charges which increases the pressure and velocity of the detonation wave produced in the explosive charge.

Another object is to provide an explosive auto-enhancement device which creates higher detonation pressures and velocities than those produced by conventional explosive charges.

Yet another object is to provide an explosive auto-enhancement device which produces higher detonation pressures and velocities by magnetic precompression of the explosive charges.

A still further object of the invention is to provide an explosive auto-enhancement device which is compact, self-contained, simple in design, and affords a substantially enhanced detonation than that obtained by conventional explosives.

A still further object of the invention is to provide an explosive auto-enhancement device which enhances the pressure and velocity of a detonation wave produced in an explosive charge.

Other objects, advantages, and novel features of the present invention will become apparent from the following detailed description of the invention when considered in conjunction with the drawings.

BRIEF DESCRIPTION OF THE DRAWINGS

A more complete appreciation of the invention and many of the attendant advantages thereof will be readily understood by reference to the following detailed description when considered with the accompanying drawings in which like reference numerals designate like parts throughout the figures and wherein.

DESCRIPTION OF THE PREFERRED EMBODIMENTS

Figure 1:
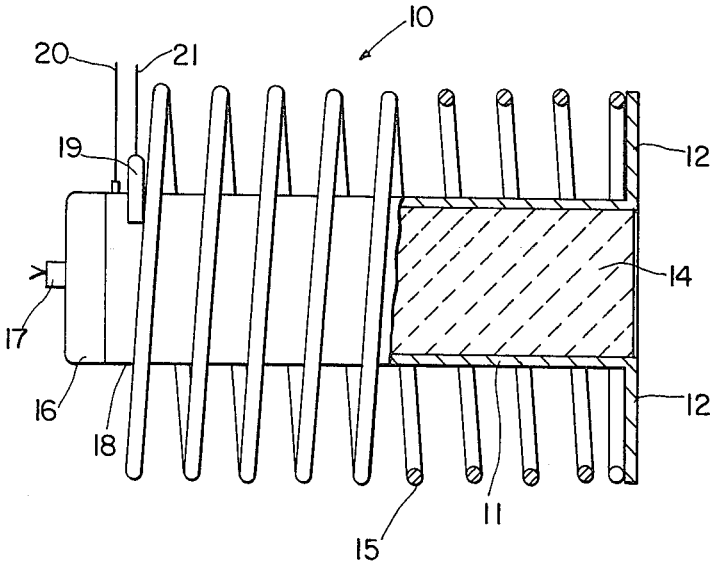
FIG. 1 shows a side view of the explosive auto-enhancement device of the present invention.

Referring to FIG. 1 there is shown an explosive auto-enhancement device 10 for providing significantly higher detonation pressures and velocities than can be achieved with conventional explosives by using magnetic precompression for enhancing the detonation wave.

Auto-enhancement device 10 is constructed with an elongate tubular conductive armature 11 having first end 12 and containing explosive charge 14 therein. Armature 11 is coaxially spaced within a helical field generator winding 15 with first end 12 of armature 11 being electrically coupled to the helical winding.

Explosive charge 14 is provided with a booster charge 16 and a detonator 17 adjacent other end 18 of armature 11. Helical winding 15 is provided with end 19 which is in close proximity to armature end 18 and thus serves as a crowbar switch. Electrical leads 20 and 21 provide a current to the helical winding and armature to generate a seed magnetic field within the helical winding prior to initiation of the device. The current may be supplied from a battery, capacitor system, or ferroelectric device.

Armature 11 is constructed of an electrically conducting material such as copper which is capable of expanding several radii without tearing. Crowbar switch 19 is designed to connect armature 11 and winding 15 upon detonation of charge 14 but can be substituted for by the expansive action of the armature itself. It is thus contemplated that the auto-enhancement device of the subject invention may be constructed without crowbar switch 19.

In detonating condensed explosives, the velocity and pressure of the detonation wave are increasing functions with increasing initial density of the explosive, even beyond the maximum density at ambient pressure, i.e., at a precompressed state. This has been verified experimentally and is the basis on which the explosive auto-enhancement device functions. In operation, a seed magnetic field is provided to helical winding 15 prior to initiation of explosive charge 14. The seed magnetic field is provided by furnishing electrical current to leads 20 and 21. The current may be supplied from a battery, capacitor system, or ferroelectric device (not shown).

Detonator 17 and booster charge 16 initiate a detonation wave in explosive charge 14. The cylindrical armature surrounding explosive charge 14 is expanded by the detonation wave and crowbars the armature to helical winding 15. The crowbarring of the armature to the helical winding completes the electrical circuit between the winding and the armature.

As the detonation wave continues along explosive charge 14, the portion of armature 11 behind the detonation wave continues to expand and clamp more of the coils of helical winding 11.

As additional coils are clamped, the inductance of the helical winding is rapidly reduced. The reduced inductance results in the generation of additional electrical energy in the winding which appears as an increased magnetic flux within the winding. The diffusion time of the magnetic field through conducting armature 11 is large compared to the transient time of the detonation wave. Hence a magnetic pressure appears ahead of the detonation wave and compresses the undisturbed armature and contained explosive.

The advancing detonation wave enters a region of precompressed explosive and develops into a wave with increased detonation velocity and pressure. The augmented wave accelerates the process of armature expansion, flux generation, and increases the degree of precompression ahead of the wave. The detonation wave is thus continually accelerated by the generation of magnetic pressure preceeding the detonation wave and results in a highly overdriven detonation wave at the end of the armature.

Figure 2:
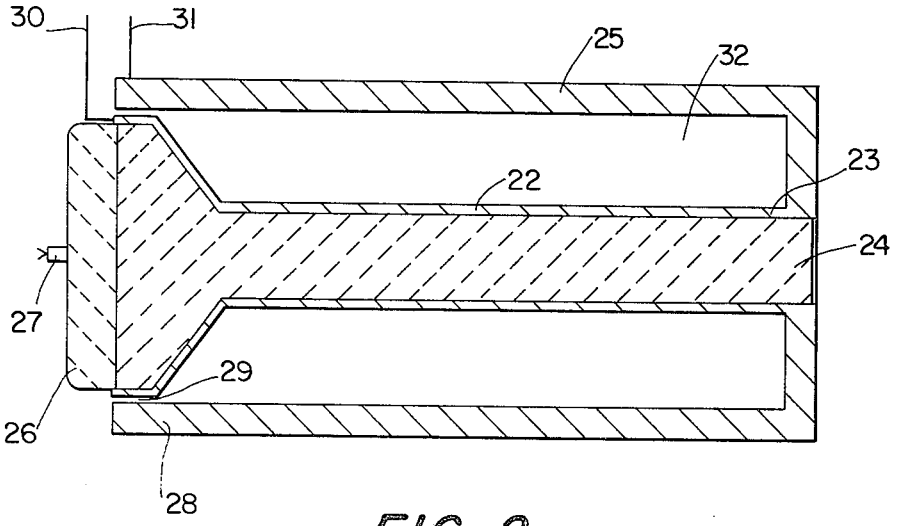
FIG. 2 shows a side view of a second embodiment of the explosive auto-enhancement device of the present invention.

Referring to FIG. 2, there is shown a second embodiment of the explosive auto-enhancement device of the subject invention. The device is constructed with a conductive armature 22 containing explosive charge 24. Explosive charge 24 is provided with detonator 27 and booster charge 26 for initiating a detonation wave in the charge. Armature 22 is coaxially positioned in outer casing 25 which is analogous to helical winding 15 of FIG. 1. Outer casing 25 is connected electrically to a first end 23 of armature 22. Other end 28 of outer casing 25 is circumferentially spaced from armature 22 so as create a crowbar switch 29. An electrical current is supplied to leads 30 and 31 to create a seed magnetic field in cavity 32 by means of outer casing 25 and armature 22. Upon initiation of a detonation wave in explosive charge 24, the expansion of the armature and the clamping of outer casing 25 generates a compressed magnetic field in cavity 32 and explosive charge 24. As the advancing detonation wave enters the region of precompressed explosive, the wave increases in detonation velocity and pressure. The augmented wave accelerates the process of armature expansion, flux generation, and increases the degree of precompression ahead of the wave thus continually accelerating the detonation wave velocity and pressure. The embodiment of explosive auto-enhancement device illustrated in FIG. 2 has the added features of simplicity and greater structural integrity over the detonation time frame.

It is apparent that the disclosed explosive auto-enhancement device provides for enhancing of the pressure and velocity of a detonation wave initiated in an explosive charge. The auto-enhancement device provides for higher detonation pressures and velocities than can be obtained with conventional explosives. The device is compact, self-contained, simple in design, affords a substantially enhanced detonation, requires no large power generation equipment, and has no inherent limitations due to break-down voltage limits.

Many obvious modifications and embodiments of the specific invention other than those set forth above, will readily come to mind to one skilled in the art having the benefit of the teachings presented in the foregoing description and the accompanying drawings of the subject invention and hence it is to be understood that such modifications are included within the scope of the appended claims.

What is claimed as new and desired to be secured by U.S. Letters Patent is:

1. A device for enhancing the detonation wave pressure and detonation wave velocity in an explosive charge, comprising:

elongate means defining an armature and supporting an elongate explosive charge generally coextensive therein, said supporting means being electrically conducting;

means forming a magnetic field surrounding the elongate supporting means, said magnetic field forming means being directly electrically connected to the supporting means at a first end thereof;

said elongate supporting means having its other end disposed in close proximity to the means forming the magnetic field to define a crowbar switch therebetween; and means at the other end of the elongate supporting means for initiating the explosive charge, the detonation wave of which travels toward the first end;

whereby, upon initial minimal expansion of the elongate supporting means at its other end, the crowbar switch is closed to complete a circuit between the electrically conductive supporting means and means forming the magnetic field so that expansion of the supporting means is opposed by the magnetic field and the explosive charge is precompressed ahead of the detonation wave thus increasing the detonation wave velocity as it travels along the explosive charge.

2. The device as in claim 1 wherein the means forming a magnetic field comprises a helical winding, said support means being positioned in the helical winding.

3. The device as in claim 1 wherein the means forming a magnetic field comprises an outer casing, said support means being positioned in the casing.

4. A device as in claims 2 or 3 wherein the means forming a magnetic field further comprises a source of power forming a seed magnetic field.

5. A device as in claim 1 wherein the explosive charge is further provided with a booster charge.

6. A device for increasing detonation wave pressure and detonation wave velocity in an explosive charge, comprising:

electrically conductive means forming a magnetic field; and, an elongate electrically conductive armature supporting the explosive charge longitudinally therein and positioned in the magnetic field, said armature being directly electrically connected at its first end to the means forming the magnetic field;

said armature at its other end being disposed in close proximity to the means forming the magnetic field to define a crowbar switch therebetween;

whereby upon initiation of the explosive charge adjacent the other end of the armature, a detonation wave is formed in the charge to travel toward the first end of the armature and initially expand the armature at its other end to close the crowbar switch in close proximity therewith and complete a circuit between the armature and means forming the magnetic field, and whereby expansion of the armature is opposed by the magnetic field and urged inwardly around the exclusive charge ahead of the detonation wave to precompress it for increasing the detonation wave velocity and detonation wave pressure passing through the charge.

7. A device as in claim 6 wherein the means forming a magnetic field comprises a helical winding.

8. A device as in claim 6 wherein the means forming a magnetic field comprises an outer casing.

9. A device as in claims 7 or 8 wherein the means forming a magnetic field further comprises a source of electrical power forming a seed magnetic field.

10. A device as in claim 6 wherein the explosive charge is provided with a detonator.

11. A device as in claim 10 wherein the explosive charge is further provided with a booster charge.

12. A device for increasing the pressure on an explosive charge for increasing velocity and pressure of a detonation wave passing therethrough comprising:

an electrically conductive tubular member defining an armature and housing an explosive charge therein;

electrically conductive means surrounding the armature for forming a magnetic field thereabout;

said armature electrically connected at its first end directly to one part of the electrically conductive magnetic field forming means;

said armature at its other end disposed in close proximity to another part of the electrically conductive magnetic field forming means to define a crowbar switch therebetween; and, means adjacent the other end of the armature for initiating the explosive charge, the detonation wave of which travels toward the first end of the armature and radially expands the armature as it progresses therealong;

said armature other end upon initial expansion closing the crowbar switch to complete an electrical circuit between the armature and the electrically conductive magnetic field forming means;

whereby, upon continued outward expansion of the armature through the magnetic field, the magnetic field is increased which reacts against outward movement of the armature and also reacts against the armature to pressurize it along its undisturbed length ahead of the detonation wave to compress the explosive charge therein for increasing the pressure and velocity of the detonation wave passing therethrough.

* * * * *